US005407232A

United States Patent [19]

DesJarlais

[11] Patent Number: 5,407,232

[45] Date of Patent: Apr. 18, 1995

[54] BINDING IMPLEMENT FOR SPIRAL BOUND BOOKS

[76] Inventor: Matt G. DesJarlais, 2034 Dugald Road, Winnipeg, Manitoba, Canada, R2J 4B7

[21] Appl. No.: 89,571

[22] Filed: Jul. 12, 1993

[51] Int. Cl.[6] ..... B42D 1/00

[52] U.S. Cl. ..... 281/16; 281/27.1; 281/28; 281/51; 402/57; 402/80 R

[58] Field of Search ..... 281/16, 21.1, 28, 51, 281/27.1; 402/4, 80 R, 57

[56] References Cited

U.S. PATENT DOCUMENTS 1,894,224 1/1933 Parsons ..... 281/16
2,051,183 8/1936 Schade ..... 281/16
4,521,123 8/1936 Jennings et al. .

FOREIGN PATENT DOCUMENTS 195967 5/1938 Switzerland ..... 281/16

*Primary Examiner*—Willmon Fridie

[57] ABSTRACT

This invention relates to a binding implement for securely joining a plurality of spiral bound books. The binding implement includes of an elongate member that is configured to be inserted into an overlapping region defined by intermeshing the spiral binding of the books. The member is secured in its position by a securing system, which can be, for example, a catch for releasably retaining loops of the binding, hooks located at the ends of the member, protrusions positioned along the member or end plugs.

4 Claims, 1 Drawing Sheet

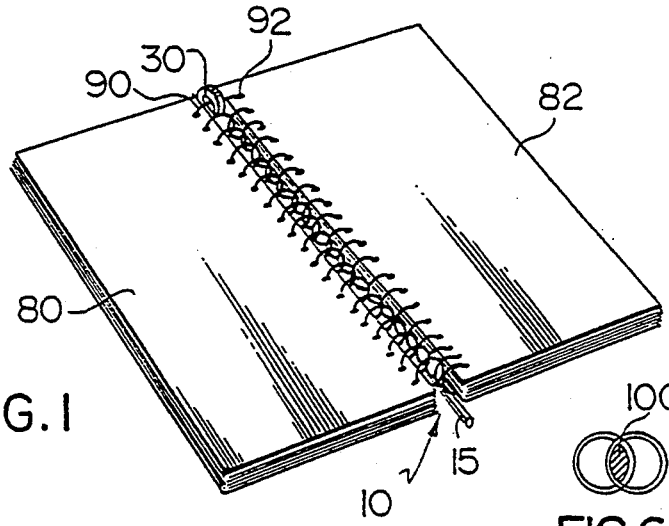
FIG. 1
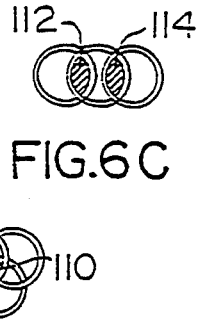
FIG.6C
FIG.6A FIG.6B
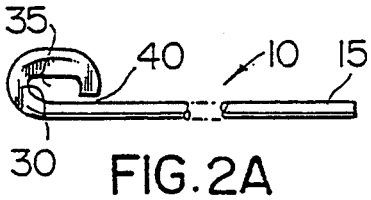
FIG.2A
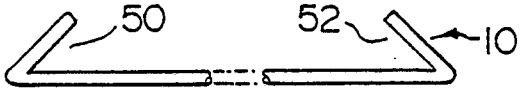
FIG.3A
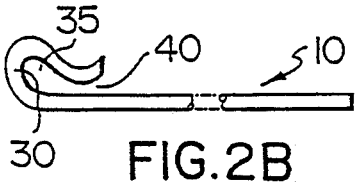
FIG.2B
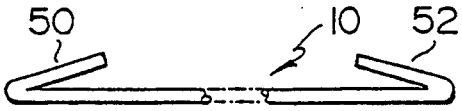
FIG.3B
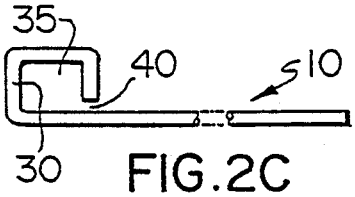
FIG.2C
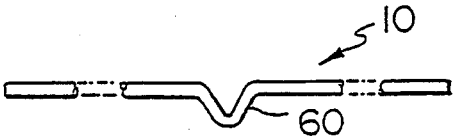
FIG.4A
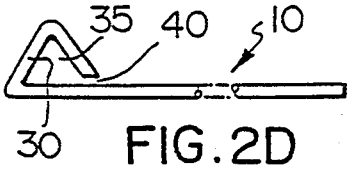
FIG.2D
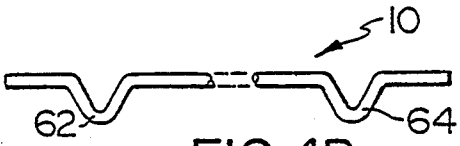
FIG.4B
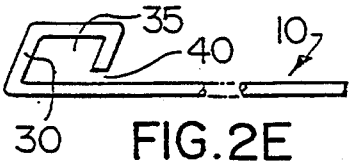
FIG.2E
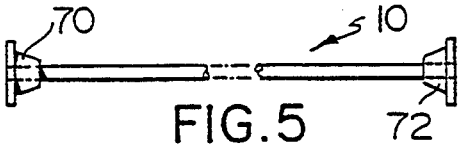
FIG.5
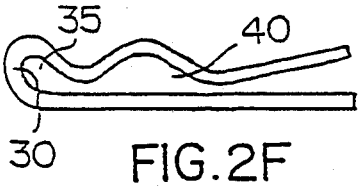
FIG.2F

BINDING IMPLEMENT FOR SPIRAL BOUND BOOKS

FIELD OF THE INVENTION

This invention relates to the field of spiral book binding. Specifically, this invention relates to coil type binding of books that exceed the diameter of the binding coil.

BACKGROUND OF THE INVENTION

The spiral binding method has been used to bind cook books, blank paged note books used commonly in schools and for many other applications. The term "spiral" in this context is being used very liberally to include any type of multiple looped binding system such as coil bound books even if the binding itself is not a purely continuous spiral.

There is often a limit to the diameter of the binding coil which precludes the binding of books that exceed the diameter of the binding coil. Consequently, if a large volume is to be coil bound and the maximum diameter coil cannot accommodate such a large number of pages then the coil binding system can not be used.

In addition, it often becomes necessary to join individually spiral bound books together to form a single volume in order to keep the books organized in an orderly fashion. In the past, joining spiral bound books has been very difficult for the following reasons:

(a) removing pages from a spiral bound book is difficult without the aid of special book binding machinery; and (b) even if removing pages from one book were possible the diameter of the looped spiral is usually sized for the number of pages being bound such that adding more pages to a book may not be feasible.

Therefore, there is a need for a binding implement capable of holding together multiple sections of a large book, each section bound individually with a spiral binding, to form a single unit.

In addition, there is a need for a binding implement that can securely join a plurality of spiral bound books together to form, essentially, one volume made of distinct books. The binding implement should be capable of (a) simultaneously joining two or more books and (b) joining a series of previously joined books to yet another book by using another binding implement.

SUMMARY OF THE INVENTION

An object of the preferred embodiment of the present invention is to provide a binding implement adapted to securely join a plurality of spiral bound books.

In accordance with one aspect of the invention there is provided a binding implement for securely joining a plurality of books each book being bound on one edge by a spiral binding comprising a plurality of loops, said binding implement comprising: an elongate member insertable into an overlapping region defined by intermeshing the spiral binding of the plurality of books, said member extending substantially the length of the bound edge of one of the plurality of books thereby defining a binding position, and securing means for retaining said member in said binding position.

In accordance with another aspect of the invention there is provided a binding implement adapted to join two spiral bound books being bound on one edge by a spiral binding comprising a plurality of loops in a binding position, said binding implement comprising: an elongate member, and securing means for retaining the member in the binding position.

In accordance with another aspect of the invention there is provided a binding system for securely joining two spiral bound books each book being bound on one edge by a spiral binding having a first and second end comprising a plurality of loops, said binding system comprising: a first member insertable into an overlapping region defined by intermeshing the spiral binding of the two books, said first member extending from the first end and partially along the length of the bound edge of one of the two books, thereby defining a first member binding position; first securing means for retaining said first member in said first member binding position; a second member insertable into an overlapping region defined by intermeshing the spiral binding of the two books, said second member extending from the second end and partially along the length of the bound edge of one of the two books, thereby defining a second member binding position; and second securing means for retaining said second member in said second member binding position.

In accordance with another aspect of the invention there is provided a method of joining a plurality of books each book being bound on one edge by a spiral binding comprising the steps of: intermeshing the spiral bindings of the plurality of books in such a manner as to develop an overlapping region; inserting an elongate member into said overlapping region extending substantially along the edge of one of the plurality of books thereby joining the books together in a binding position; and securing the member in the binding position.

In preferred forms of the invention, the securing means can include, for example, a catch for releasably retaining at least two loops if two books are being joined; or can be hooks located near the ends of the elongate member; or protrusion elements located on the elongate rod itself or end caps to retain the member in a binding position. Details of these preferred securing means will be discussed hereinbelow in conjunction with the drawings.

BRIEF DESCRIPTION OF THE DRAWINGS

Embodiments of the invention will be described by way of example in conjunction with the drawings in which:

FIG. 1 illustrates a perspective view of two spiral bound books secured together by the binding implement of the present invention;

FIGS. 2A–2F illustrate plan views of the binding implement according to the first embodiment of the invention;

FIGS. 3A and 3B illustrate plan views of the binding implement according to the second embodiment of the invention;

FIGS. 4A and 4B illustrate plan views of the binding implement according to the third embodiment of the invention;

FIG. 5 illustrates a plan view of the binding implement according to the four embodiment of the invention; and FIGS. 6A–6C illustrate schematically the overlapping region of intermeshed loops from spiral bound books.

DETAILED DESCRIPTION OF EMBODIMENTS OF THE INVENTION

FIG. 1 illustrates a binding implement 10 securely joining two spiral bound books 80 and 82. The binding implement 10 includes an elongate rod 15 and securing means (30; 50, 52; 60; 62, 64; and 70, 72) for securing the rod 15 of the binding implement 10 in a binding position as shown in FIG. 1.

The rod 15 is illustrated as having a circular cross section but the rod 15 could also have, for example, elliptical, square or rectangular cross sections.

In the first embodiment of the present invention the securing means includes a catch 30 positioned at or near one end of the rod 15 as illustrated in FIGS. 2A–2F. The catch 30 defines a cavity 35 adapted to accommodate at least two rings, one ring 90 from book 80 and another ring 92 from book 82. The catch 30 has a defined entry and exit region 40 located at one end of the catch 30. The entry and exit region 40 is smaller than the diameter of the rings 90 and 92 such that when the binding implement 10 is in the binding position (as shown in FIG. 1) the rings 90 and 92 will not easily be disengaged from the catch 30.

Either the rod 15, catch 30 or both the rod 15 and catch 30 should be made of a flexible material such that the entry and exit region 40 can be temporarily increased in size to engage over the rings 90 and 92 when the binding implement 10 is being secured to the binding position.

The catch 30 can be either integrally formed with the rod 15 or secured, by gluing for example, to the rod 15 as a separate piece.

The configuration of the catch 30 does not effect the binding properties of the implement 10 provided the cavity 35 formed can accommodate at least two loops as previously discussed. FIG. 2A shows the catch 15 formed as an ellipse having an inwardly extending portion; however, the catch 15 could also be, for example, circular, square, triangular or rectangular as shown in FIGS. 2B–2E respectively.

Alternatively, FIG. 2F shows the rod 15 being relatively short, compared to the rod 15 of FIGS. 2A–2E, such that two implements 10 would be used to join spiral bound books, one at each end of the books 80 and 82. Although this form of implement 10 has many cavities the primary cavity 35 and the main entry and exit point 40 are structurally similar to the equivalent features discussed with reference to FIGS. 2A–2E.

In the second embodiment the securing means includes a pair of hooks 50 and 52 positioned at or near the two ends of the rod 15 as illustrated in FIGS. 3A and 3B. The hooks 50 and 52 are integrally formed with the rod 15 by bending the end portions of the rod to an appropriate angle. The appropriate angle of the hooks 50 and 52 relative to the rod 15 must be such that the rod 15 can be mounted into the binding position (as shown in FIG. 1), and once in the binding position the hooks 50 and 52 will catch the outer rings of the books 80 and 82 to secure the rod 15.

In the third embodiment the securing means includes a protrusion element 60 as illustrated in FIG. 4A or a plurality of protrusion elements 62 and 64 as illustrated in FIG. 4B. The protrusion element 60 is created by moulding the rod 15 to create an inverted V near the middle of the rod 15 in the embodiment shown in FIG. 4A. Alternatively, FIG. 4B shows two protrusion elements 62 and 64 spaced along the rod 15. In this embodiment, the protrusion element 60, or 62 and 64 are sufficient to secure the rod 15 in the binding position by protruding between the space in the rings of the intermeshed spiral bound books 80 and 82.

In the fourth embodiment the securing means includes a pair of end caps 70 and 72. The end caps 70 and 72 are merely attached to the two ends of the rod 15 when the rod 15 is in the binding position (as shown in FIG. 1) such that the rod 15 cannot slide out from the binding position.

The binding implement 10 of the present invention can be used to simultaneously join a plurality of books, a limiting factor being the size of the spiral loops. For example, FIG. 6A shows an overlapping region 100 when the spiral bindings of two books are intermeshed; and FIG. 6B shows another overlapping region 110 developed when the spiral bindings of three books are intermeshed.

Alternatively, where three books are to joined, they could be intermeshed as shown in FIG. 6C by generating two overlapping regions 112 and 114. Such an arrangement will require the use of two binding implements 10. Similarly, if four spiral bound books are to be joined, then three binding implements 10 will be required; and if five spiral bound books are to be joined, then four binding implements will be required.

In summary, when joining more than two spiral bound books together the embodiment of FIG. 6B can be used if the individual spiral bindings of the individual books are not bound to capacity thereby leaving ample space to intermesh the bindings to generate an interface regions similar to 110. However, if the individual books already maximize the spiral binding capacity then chaining the books together with multiple binding implements 10, as illustrated in FIG. 6C, would be the most efficient system.

To use the binding implement 10 a plurality of books are placed in such a manner to intermesh their respective spiral bindings to develop an overlapping region (see FIG. 6A and 6B as examples). The rod 15 is then inserted into the defined overlapping region 100 or 110 thereby joining the books together in the binding position (as illustrated in FIG. 1). The securing means 30; 50, 52; 60; 62, 64; or 70, 72 is used to retain the rod 15 in its binding position.

Consequently, in the first embodiment the catch 30 is engaged over at least two rings 90 and 92, such that the rings 90 and 92 are placed in the cavity 35 of the catch 30. In the second embodiment the hooks 50 and 52 themselves act as the securing means by not easily permitting the rod 15 to be disengaged from the binding position. In the third embodiment the protrusion element 60 or elements 62 and 64 that project from rod 15 between the loops of the intermeshed books provide the securing means. In the fourth embodiment end caps 70 and 72 are attached to the ends of the rod 15 when the rod 15 is in the binding position thereby locking the rod 15 in place.

The embodiments of the invention in which an exclusive property or privilege is claimed are defined as follows:

1. A binding implement for securely joining a plurality of books each book being bound on one edge by a spiral binding comprising a plurality of loops, said binding implement comprising:

an elongate member having two ends insertable into an overlapping region defined by intermeshing the spiral binding of the plurality of books, said member extending substantially the length of the bound edge of one of the plurality of books thereby defining a binding position, and securing means for retaining said member in said binding position, wherein the securing means includes a protrusion element positioned intermediate the two ends of said member, whereby when said member is in said binding position the protrusion element protrudes through the plurality of loops of the plurality of books.

2. A binding implement for securely joining a plurality of books each book being bound on one edge by a spiral binding comprising a plurality of loops, said binding implement comprising:

an elongate member having two ends insertable into an overlapping region defined by intermeshing the spiral binding of the plurality of books, said member extending substantially the length of the bound edge of one of the plurality of books thereby defining a binding position, and securing means for retaining said member in said binding position, wherein the securing means includes plug means securable to the two ends of said member when said member is in said binding position.

3. A binding implement adapted to join two spiral bound books being bound on one edge by a spiral binding comprising a plurality of loops in a binding position, said binding implement comprising:

an elongate member having two ends insertable into an overlapping region defined by intermeshing the spiral binding of the books, and securing means for retaining said member in said binding position, wherein the securing means includes a plurality of protrusion elements spaced between the two ends of the member, whereby when said member is in said binding position the protrusion elements protrude through the plurality of loops of the books.

4. A binding implement for securely joining two spiral bound books each book being bound on one edge by a spiral binding comprising a plurality of loops, said binding implement comprising:

an elongate member having two ends insertable into an overlapping region defined by intermeshing the spiral binding of the books, said member extending substantially the length of the bound edge of one of the books thereby defining a binding position, and catch means positioned near at least one of the two ends of said member for releasably retaining at least one of the loops from each of the books being joined, wherein the catch means includes a cavity portion adapted to receive at least one of the loops from each of the books being joined and an entry and exit region to the cavity portion, said entry and exit region being smaller than the cavity portion, and smaller than the cross-sectional diameter of one of the loops of one of the books.

* * * * *